US005861785A

United States Patent [19]

Kobayashi et al.

[11] Patent Number: 5,861,785

[45] Date of Patent: Jan. 19, 1999

[54] ELECTROMAGNETIC RELAY

[75] Inventors: Shigeru Kobayashi; Nobuo Ishibashi; Masaaki Tanabe, all of Tokyo, Japan

[73] Assignee: Niles Parts Co., Ltd., Japan

[21] Appl. No.: 777,964

[22] Filed: Dec. 24, 1996

[30] Foreign Application Priority Data

Dec. 28, 1995 [JP] Japan ..... 7-353041

[51] Int. Cl.[6] ..... H01H 51/22

[52] U.S. Cl. ..... 335/85; 335/281

[58] Field of Search ..... 335/78–86, 124, 335/128, 250, 281

[56] References Cited

U.S. PATENT DOCUMENTS

| | | | |
|---|---|---|---|
| 3,896,405 | 7/1975 | Pauli | 335/281 |
| 4,365,223 | 12/1982 | Fechant et al. | 335/281 |
| 4,443,775 | 4/1984 | Fujitani et al. | 335/251 |
| 4,596,972 | 6/1986 | Knight et al. | 335/281 |

FOREIGN PATENT DOCUMENTS 2-104547 8/1990 Japan .

*Primary Examiner*—Lincoln Donovan

*Attorney, Agent, or Firm*—Rader, Fishman & Grauer; Ronald P. Kananen

[57] ABSTRACT

An electromagnetic relay, having a core 3 fixed by press-fitting in a yoke 4, which is facilitated in attaching operation and eliminated of the possibility, during press-fitting, of being placed in poor contact by metal chips produced by cutting away the yoke 4 by the core 3. The core 3 is provided with a smaller diameter portion 3*c* at an end portion and is inserted into a center of a bobbin 1 having a coil 2 wound therearound. A cutout 5 is formed in the yoke 4 so as to receive by press-fitting the smaller diameter portion 3*c* of the core 3. First slant surfaces 6 are formed in the edge of an opening of the cutout 5 such that the wall thickness becomes thinner toward the opening. Second slant surfaces 7 are provided in the form of curved surfaces at the terminal ends of the first slant surfaces in a manner smoothly continuing to a general surface of the yoke 4 and also to the first slant surfaces 6. The terminal ends of the second slant surfaces 7 are positioned on a diametrical center line of the core 3 when the core 3 is attached to the yoke 4.

12 Claims, 5 Drawing Sheets

ELECTROMAGNETIC RELAY

BACKGROUND OF THE INVENTION

1. Field of the Invention

The present invention relates to generally to electromagnetic relays and, in particular, to a structure for electromagnetic relays having a core, inserted through, a center of a bobbin, to be attached onto a yoke.

2. Description of the Prior Art

A conventional electromagnetic relay has a core attached to a yoke by staking, as disclosed, for example, in Japanese Unexamined Utility Model Publication No. S57-72540. With such stake-fastening, however, the assembling of an armature and a leaf spring, referred to as an armature spring, onto a core had to be performed after the clamp-fastening step of the core and the yoke, due to necessity of working processes. As a result, it has been difficult to obtain accurate control of the angle of attachment of the yoke with the armature.

Another electromagnetic relay structure is disclosed in Japanese Unexamined Utility Model Publication No. H2-104547, wherein a core is press-fitted into a cutout formed in a yoke. In this structure, the core has a smaller diameter portion formed adjacent one end thereof, and a cutout is provided in a bottom plate of an L-shaped yoke, thereby allowing the smaller diameter portion to be press-fitted in the cutout of the yoke.

With this structure, the problem concerning the accuracy control of the attachment angle for the yoke and the armature is solved. However, a large amount of press-fitting force is initially required during press-fitting of the core into the yoke, worsening the operation efficiency. Also, the bottom plate of the yoke is cut away by a peripheral edge of a larger diameter portion of the core, thereby producing chips. This creates a new problem in that the chips are adhered to contact portions or other operating portions within a case of the electromagnetic relay, thereby causing poor operation.

SUMMARY OF THE INVENTION

It is an object of the present invention to provide an electromagnetic relay that solves the problems associated with the conventional relay structures.

It is a further object of the present invention to provide an attachment structure for an electromagnetic relay which facilitates attachment of a core to a yoke without producing chips.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, an electromagnetic relay is provided having a bobbin, a core inserted into a center of the bobbin, and a yoke to which the core is attached, the electromagnetic relay comprising a smaller diameter portion formed adjacent an end of the core, a cutout formed in the yoke so as to receive by press-fitting the smaller diameter portion of the core, and first slant surfaces formed in the edge of an opening of the cutout such that the wall thickness becomes thinner toward the opening.

The electromagnetic relay preferably further comprises second slant surfaces each formed in the yoke at a respective deep end of the first slant surfaces in a manner continuing from the respective first slant surface to a general surface. The second slant surfaces each has a terminal end positioned at or between a diametrical center line of the core and a crossing point of a larger diameter portion of the core with the cutout edge when the core is attached to the yoke.

The second slant surface may be in the form of a curved surface smoothly continuing from the first slant surface in the opening edge. The first and second slant surfaces are preferably formed in a surface positioned remote from the bobbin on the yoke.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENTS

Figure 1:
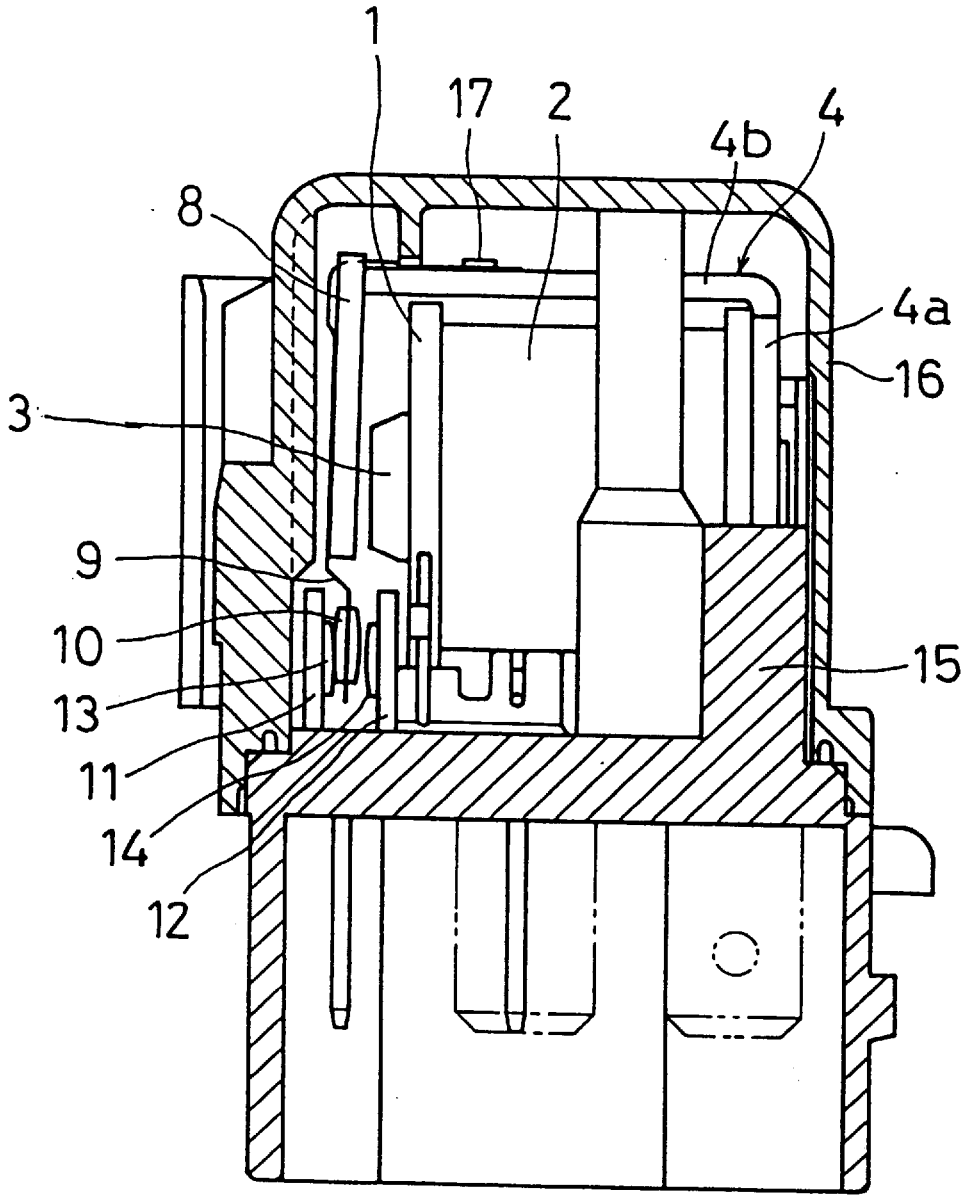
FIG. 1 is a front view showing a first embodiment of the present invention.

A first embodiment of the present invention will now be described with reference to FIGS. 1 to 4 of the accompanying drawings.

An electromagnetic relay structure according to the first embodiment includes a bobbin 1 having a coil 5 wound therearound, with an iron core 3 inserted through a center of the bobbin. A yoke 4 is provided for supporting the bobbin 1 via the core 3. The relay structure also includes an armature 8, a leaf spring 9, and a movable contact 10 provided at a tip end of the leaf spring 9. Fixed contact pieces 11, 12 have respective fixed contacts at their tip ends positioned opposed to the movable contact 10. A base 15 is provided for supporting the bobbin 1 and the core 3. A case 16 is fixed on the base 15 for accommodating therein the bobbin 1, the yoke 4, and so forth.

The core 3 is a rod member in a T form, which comprises a head flange 3*a*, a shaft portion 3*b*, and a smaller diameter portion 3*c* formed adjacent one end of the shaft portion 3*b*. The larger diameter portion (the shaft portion) 3*b* of the core has a chamfered face 3*e*, 3*e* formed in an end edge continuing to the smaller diameter portion 3*c*.

The yoke 4 is in an L form which comprises a bottom plate 4*a* formed with a cutout 5 to which the smaller diameter portion 3*c* of the core 3 is press-fitted, and a lateral plate 4*b* having a top end on which the leaf spring 9 firmly attached to the armature 8 is firmly fixed through staking a rivet 17.

The cutout 5 comprises parallel portions 5*a* extending from an end portion of the bottom plate 4*a*, an arcuate portion 5*b* formed at a terminal end thereof to conform to the contour of the smaller diameter portion 3*c* of the core 3, and a pair of guide portions 5*c* formed at an entrance of the parallel portions 5*a*. First slant surfaces 6, 6 are formed on the respective sides of the parallel portions 5*a* such that the wall thickness becomes thinner toward the side of the opening by the cutout 5. The first slant surfaces 6, 6 are provided on the surface of the bottom plate 4*a* reverse to the position on which the bobbin 1 is mounted. The outer-side span width L between the first slant surfaces 6, 6 is provided greater than the dimension D of the larger diameter portion 3*b* of the core 3. That is, the associated plate thickness Y in the slant surface 6 is somewhat smaller than the axial dimension X of the smaller diameter portion 3*c*.

Figure 2:
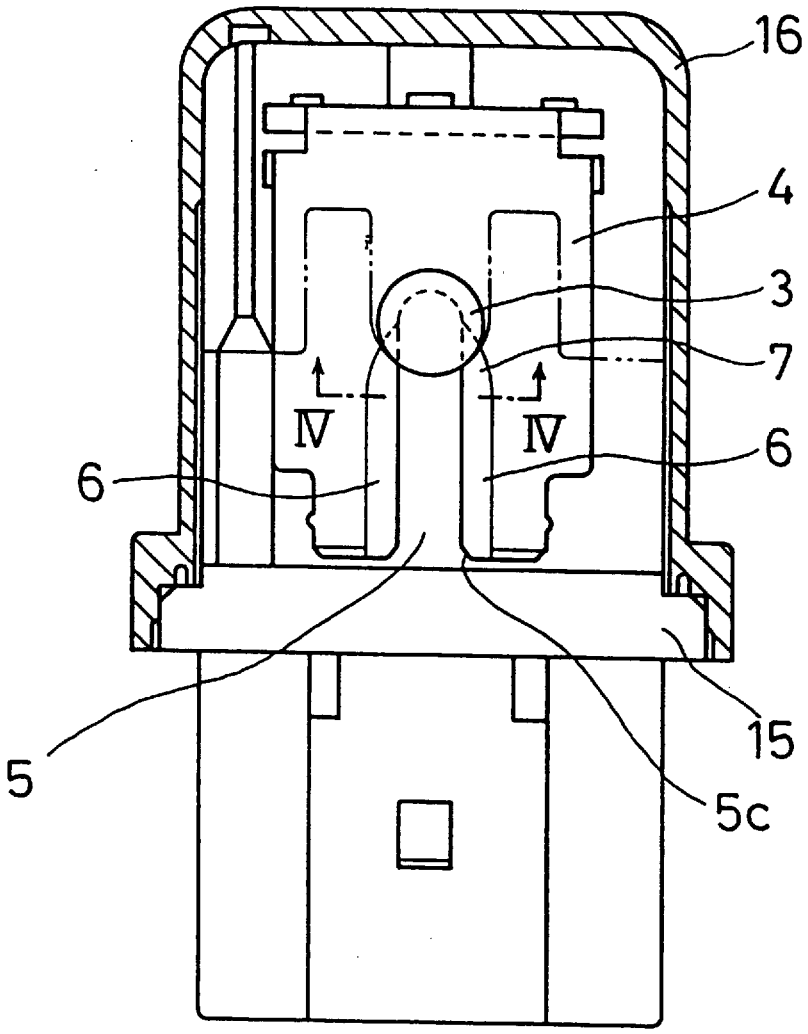
FIG. 2 is a side view showing the first embodiment of the present invention.
Figure 3:
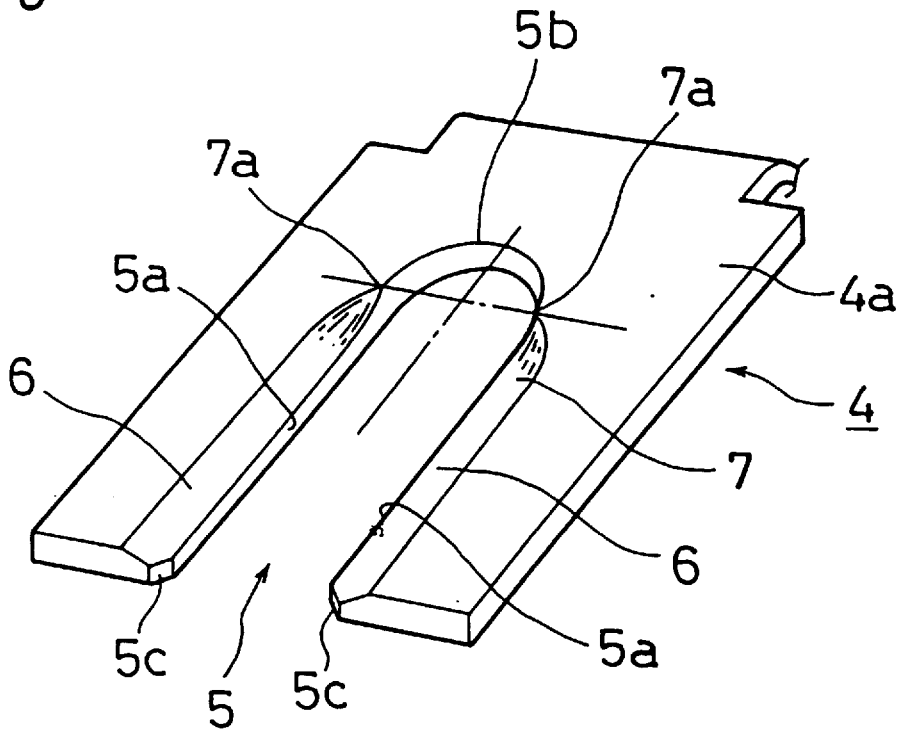
FIG. 3 is a perspective view of a yoke of the first embodiment shown in FIG. 1.
Figure 4:
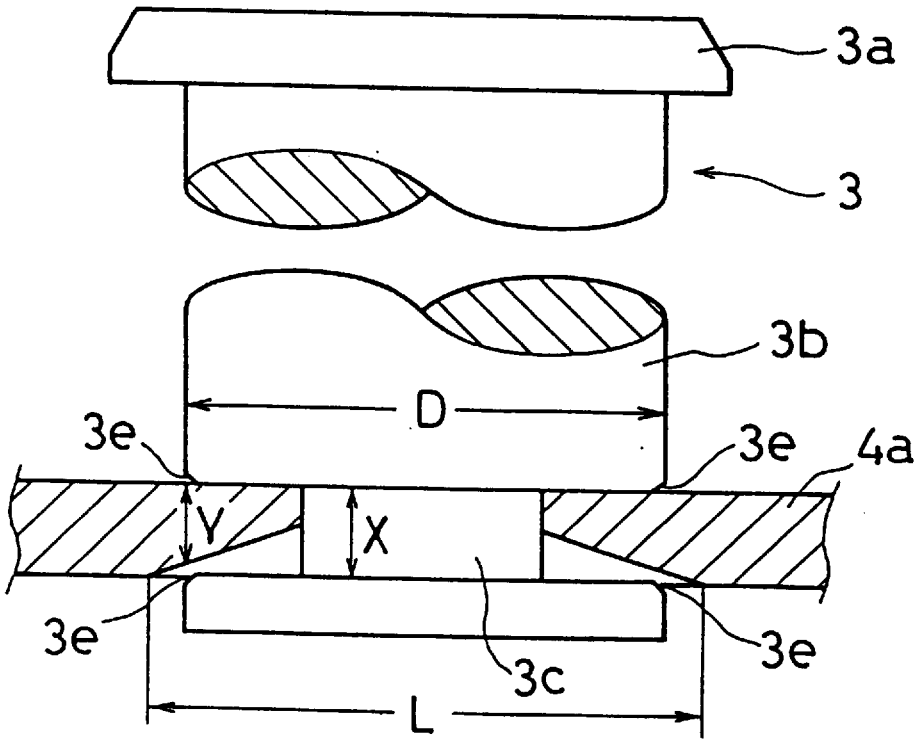
FIG. 4 is a sectional view taken along line IV—IV in FIG. 2.

Further, the first slant surface 6 has a terminal end to which a second slant surface 7 is smoothly and continuously connected. The second slant surface 7 is in the form of a curved surface having an edge on the cutout 5 formed to become gradually shallower in continuation of the general surface. The second slant surface 7, as shown in FIGS. 2 and 3, has an outer-side edge curved to gradually narrow the width thereof, so that a terminal end 7*a* thereof is positioned on the diametrical center line of the core 3 to be attached. That is, the terminal end 7*a* is positioned in a center line of the arcuate portion 5*b* of the cutout 5.

The electromagnetic relay structure described above is assembled as described below.

First, the leaf spring 9, which is firmly fixed with the armature 8, is fastened by staking a rivet 17 to the upper end 4*b* of the yoke 4. In this case, the angle of attachment between the yoke 4 and the armature 8 with the leaf spring 9 can be easily set by the use of an angle-setting jig or the like with improved accuracy, because the bobbin 1 and the core 3 are not yet attached.

Then, the core 3 is inserted through the bobbin 1 wound around the coil 2, to press-fit the smaller diameter portion 3*c* of the core into the cutout 5 of the yoke 4. This press-fitting operation can be easily carried out by using a press-fitting tool. In the present invention, however, the widened guide portions 5*c* are provided at the entrance for the cutout 5, and the first slant surfaces 6, 6 are formed along the edge of the cutout 5, thereby facilitating positioning during assembly of the core 3 onto the yoke 4. Further, the first slant surface 6 continues smoothly to the general surface through the second slant surface 7, which allows the force for press-fitting to be increased smoothly and continuously as compared with the conventional structure, further facilitating assembly. This provides smoothness in commencement of slide contact between the end edge of the cutout 5 and the core larger diameter portion 3*b*, and facilitates positioning of the core large diameter portion 3*b* over the general surface of the yoke bottom plate 4*a*. Further, the terminal end 7*a* of the second slant surface 7 is on the position of the center line of the core 3, shortening the distance of slide contact therebetween.

Thereafter, the bottom plate 4*a* of the yoke 4 is firmly fixed by press-fitting at its tip end onto the base 15 having the fixed contact pieces 11, 12 attached thereon.

The electromagnetic relay thus assembled has a movable contact 10 which is in contact with a normally-close fixed contact 13. When the coil 2 is energized, the armature 8 is attracted toward the end 3*a* of the core 3 against the urging force by the leaf spring 9, bringing the movable contact 10 into contact with the normally open fixed contact 12.

Figure 5:
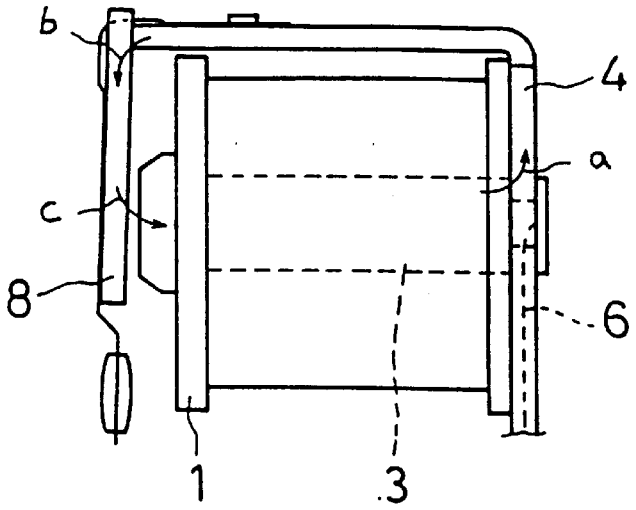
FIG. 5 is an essential part explanatory view showing the stream of magnetism in the first embodiment of FIG. 1.

FIG. 5 shows the stream of magnetism caused when the coil 2 is energized, wherein the magnetism passes from the core 3, via the yoke 4 and the armature 8, to the core head 3*a*, in a manner shown by the arrows (a) to (c). In this embodiment, the slant surfaces 6, 7 are provided in the surface of the yoke bottom plate 4*a* positioned remote from the bobbin 1. The end face proceeding from the core larger portion 3*b* to the smaller diameter portion 3*c* on the side of the bobbin 1 entirely contacts with the yoke 4, thereby eliminating any impediment against the passage of magnetism.

Figure 6:
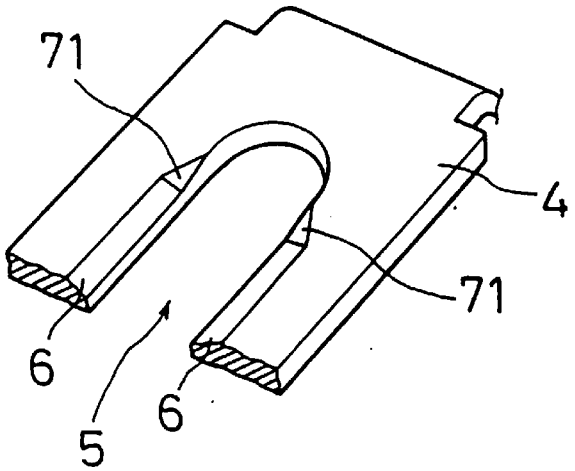
FIG. 6 is a perspective view of a yoke according to a second embodiment of the present invention.
Figure 7:
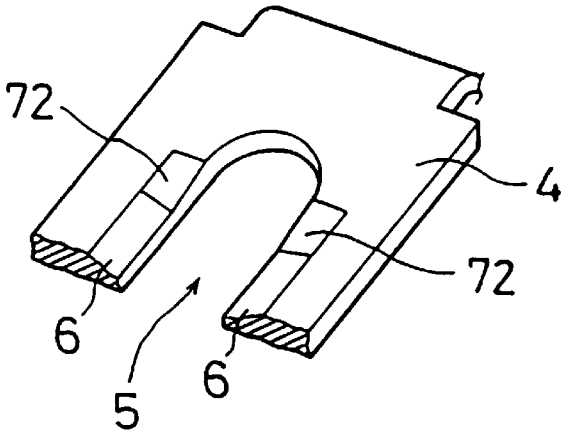
FIG. 7 is a perspective view of a yoke according to a third embodiment of the present invention.
Figure 8:
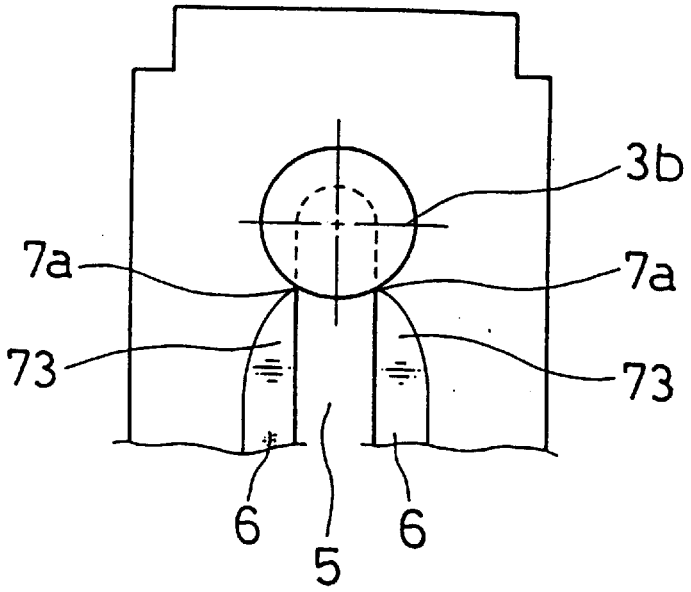
FIG. 8 is a perspective view of a yoke according to a fourth embodiment of the present invention.

FIGS. 6 to 8 show other embodiments of the yoke 4 according to the present invention. In FIG. 6, the second slant surfaces 71 assume a plane surface. In FIG. 7, the second slant surfaces 72 have a slant angle gradually reduced with the width thereof kept the same as that of the first slant surface 6 so as to transition into the general surface. In FIG. 8, the second slant surfaces 73 each have a terminal end 7*a* provided at a crossing point between the edge of the cutout 5 and the larger diameter portion 3*b*, in front of the center line of the core 3.

Figure 9:
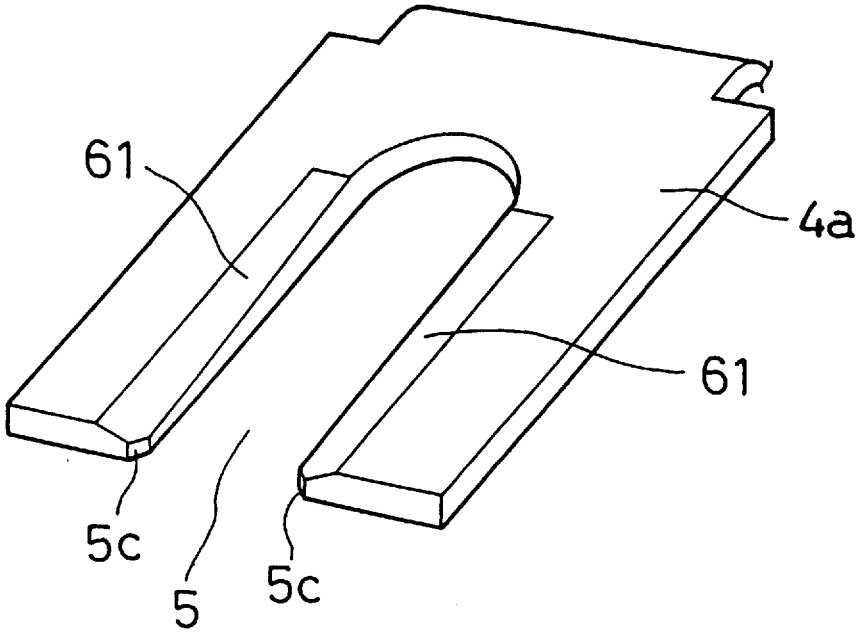
FIG. 9 is a perspective view of a yoke according to a fifth embodiment of the present invention.

Incidentally, in each of the embodiments described above, two slant surfaces are provided. Alternatively, as shown in FIG. 9, the slant surface may comprise a single slant surface 61 formed such that it is gradually reduced in slant angle from the entrance of the cutout 5 toward the general surface at the terminal end.

The electromagnetic relay structure according to the present invention, as described above, provides the following features and advantages:

(1) Slant surfaces are formed in the edge of an opening of the cutout such that the wall thickness becomes thinner toward the opening. It is therefore possible to reduce the press-fitting force initially applied upon press-fitting the core, thereby improving the operation efficiency. Moreover, during press-fitting, there is no possibility of cutting the bottom plate of the yoke by the core larger diameter portion, thereby eliminating the fear of poor operation due to chips being produced during the assembly process.

(2) The second slant surfaces are formed at a deep end of the slant surface in a manner continuing from the slant surface to a general surface. It is therefore possible, during press-fitting, to press-fit the core smoothly from the entrance of the cutout to the finally attached position, thereby eliminating the production of chips during assembly due to sliding contact between the end edge of the core larger diameter portion and the yoke bottom plate.

(3) The second slant surfaces each has a terminal end positioned at or between a diametrical center line of the core and a crossing point of a larger diameter portion of the core with the cutout edge when the core is attached to the yoke. It is therefore possible to provide a sliding contact area after attachment, while eliminating chips being produced during assembly by shortening the distance, during press-fitting, of sliding contact between the core larger diameter portion and the yoke general surface. Accordingly, the stability in holding the core attached to the yoke is enhanced. Also, the contact area between the core and the yoke is maximized to eliminate any impediment against the stream of magnetism flowing from the core to the yoke.

(4) The second slant surface is in the form of a curved surface. It is therefore possible to provide a smooth transition from the slant surface along the cutout opening edge to the second slant surface, and further to the general surface, thereby positively preventing against the occurrence of chips by press-fitting the core.

(5) The slant surface is formed in a surface positioned remote from the bobbin on the yoke, so that the end face, on the bobbin side, between the core larger diameter portion and the smaller diameter portion is entirely formed in the yoke. It is therefore possible to stabilize the operation of the electromagnetic relay without restraining the stream of magnetism from the core to the yoke.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. An electromagnetic relay having a bobbin, a core inserted into a center of said bobbin, and a yoke to which said core is attached, said electromagnetic relay comprising:

a smaller diameter portion formed on said core adjacent an end of said core, said smaller diameter portion having a smaller diameter than a shaft portion of said core located on either side of said smaller diameter portion;

a cutout formed in said yoke so as to receive by press-fitting said smaller diameter portion of said core, said cutout having an opening end for receiving said smaller diameter portion and a closed terminal end opposite said opening end; and first slant surfaces formed adjacent to opposing side edges of said cutout such that a wall thickness of the yoke adjacent said cutout becomes thinner toward said cutout.

2. The electromagnetic relay according to claim 1, further comprising second slant surfaces each formed adjacent said first slant surfaces in a manner continuing from said first slant surfaces to a general surface of said yoke, said second slant surfaces being angled such that the wall thickness of the yoke adjacent the cutout becomes thicker along said second slant surfaces in a direction toward said terminal end.

3. The electromagnetic relay according to claim 2, wherein said second slant surfaces each has a first end adjacent a respective one of said first slant surfaces and a second end located between said first end and said terminal end of the cutout, said second end being positioned at a diametrical center line of the core or between the diametrical center line of the core and a crossing point of a larger diameter portion of said core with said cutout edge.

4. The electromagnetic relay according to claim 2, wherein each of said second slant surfaces is in the form of a curved surface smoothly continuing from said first slant surface in said opposing side edges.

5. The electromagnetic relay according to claim 3, wherein each of said second slant surfaces is in the form of a curved surface smoothly continuing from said first slant surface in said opposing side edges.

6. The electromagnetic relay according to claim 5, wherein each of said first slant surfaces is formed in a surface of said yoke which is positioned remote from said bobbin.

7. The electromagnetic relay according to claim 1, wherein each of said first slant surfaces is formed in a surface of said yoke which is positioned remote from said bobbin.

8. An electromagnetic relay comprising:

a bobbin having a central opening;

a core inserted into said central opening of said bobbin, said core having a circumferential groove adjacent one end thereof; and a yoke comprising a cutout for receiving said core, said cutout being mated with said circumferential groove of said core by press-fitting;

wherein said yoke comprises first slant surfaces formed adjacent to opposing side edges of said cutout such that a wall thickness of the yoke adjacent said cutout becomes thinner toward said cutout to facilitate insertion of said core into said cutout.

9. The electromagnetic relay according to claim 8, wherein said first slant surfaces are formed in a surface of said yoke on an opposite side of said yoke from said bobbin.

10. The electromagnetic relay according to claim 8, further comprising second slant surfaces formed adjacent said first slant surfaces on opposing side edges of said cutout, said second slant surfaces being angled at a steeper angle than said first slant surfaces such that the wall thickness of the yoke adjacent the cutout becomes thinner along said second slant surfaces in a direction of an opening of said cutout.

11. The electromagnetic relay according to claim 10, wherein said second slant surfaces each has a terminal end positioned at a diametrical center line of the core.

12. The electromagnetic relay according to claim 10, wherein said second slant surfaces each has a terminal end positioned at a crossing point of a circumference of a large end portion of said core with said cutout edge.

* * * * *